US010197231B2

(12) United States Patent
Libon et al.

(10) Patent No.: US 10,197,231 B2
(45) Date of Patent: Feb. 5, 2019

(54) LIGHTING ARRANGEMENT

(71) Applicant: PHILIPS LIGHTING HOLDING B.V., Eindhoven (NL)

(72) Inventors: Sébastien Paul René Libon, Tervuren (BE); Johannes Wilhelmus Weekamp, Beek en Donk (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/036,083

(22) PCT Filed: Nov. 12, 2014

(86) PCT No.: PCT/EP2014/074324
§ 371 (c)(1),
(2) Date: May 12, 2016

(87) PCT Pub. No.: WO2015/074923
PCT Pub. Date: May 28, 2015

(65) Prior Publication Data

US 2016/0290575 A1 Oct. 6, 2016

(30) Foreign Application Priority Data

Nov. 19, 2013 (EP) ..... 13193461

(51) Int. Cl.

| | |
|---|---|
| ***F21S 4/15*** | (2016.01) |
| ***B21F 27/08*** | (2006.01) |
| *F21K 9/90* | (2016.01) |
| *F21Y 115/10* | (2016.01) |
| *F21Y 101/00* | (2016.01) |

(52) U.S. Cl.
CPC ..... *F21S 4/15* (2016.01); *B21F 27/08* (2013.01); *F21K 9/90* (2013.01); *F21Y 2101/00* (2013.01); *F21Y 2115/10* (2016.08)

(58) Field of Classification Search
USPC ..... 362/249.06
See application file for complete search history.

(56) References Cited

U.S. PATENT DOCUMENTS

| | | | | |
|---|---|---|---|---|
| 5,893,634 | A | 4/1999 | Wang | |
| 6,257,738 | B1 | 6/2001 | Hsu | |
| 9,541,269 | B2 * | 1/2017 | Libon | F21V 31/04 |
| 9,841,170 | B2 * | 12/2017 | Libon | H05K 7/20509 |

(Continued)

FOREIGN PATENT DOCUMENTS

| | | | |
|---|---|---|---|
| EP | 0645748 | A1 | 3/1995 |
| WO | 9853930 | A1 | 12/1998 |

*Primary Examiner* — Michael G Lee
*Assistant Examiner* — David Tardif
(74) *Attorney, Agent, or Firm* — Akarsh P. Belagodu

(57) ABSTRACT

A lighting arrangement (10) is disclosed that comprises a plurality of solid state lighting elements (22) mounted on a grid of conductive wires (12), said grid comprising a plurality of grid segments (20) each defined by respective portions of adjacent conductive wires, each grid segment comprising a pair of reinforcement members (24, 26) affixed to said portions; and at least one said solid state lighting element mounted on said portions in between the reinforcement members of at least some of the grid segments. An apparatus and method for deforming such a lighting arrangement are also disclosed.

14 Claims, 11 Drawing Sheets

(56) References Cited

U.S. PATENT DOCUMENTS

| | | | | |
|---|---|---|---|---|
| 2007/0103824 | A1* | 5/2007 | Patterson | H02G 3/00 361/54 |
| 2008/0038506 | A1 | 2/2008 | Schumacher et al. | |
| 2009/0091932 | A1* | 4/2009 | Weekamp | B21F 45/00 362/249.02 |
| 2010/0220046 | A1 | 9/2010 | Plötz et al. | |
| 2013/0100670 | A1* | 4/2013 | Dreeben | F21V 29/83 362/249.02 |
| 2016/0290575 | A1* | 10/2016 | Libon | B21F 27/08 |

* cited by examiner

LIGHTING ARRANGEMENT

CROSS-REFERENCE TO PRIOR APPLICATIONS

This application is the U.S. National Phase application under 35 U.S.C. § 371 of International Application No. PCT/EP2014/074324, filed on Nov. 12, 2014, which claims the benefit of European Patent Application No. 13193461.4, filed on Nov. 19, 2013. These applications are hereby incorporated by reference herein.

FIELD OF THE INVENTION

The present invention relates to a lighting arrangement comprising a plurality of solid state lighting elements mounted on a grid of conductive wires, said grid comprising a plurality of grid segments each defined by respective portions of adjacent conductive wires.

The present invention further relates to an apparatus for deforming such a lighting arrangement, and to a method of deforming such a lighting arrangement.

BACKGROUND OF THE INVENTION

Solid state lighting, e.g. lighting based on light emitting diodes (LEDs), is increasingly considered as the environmentally responsible replacement of more energy-inefficient traditional alternatives such as fluorescent and incandescent light sources. In addition, solid state lighting has found its way into new application domains, such as liquid crystal display technology, where backlights made from LEDs yield a superior viewing experience compared to more traditional backlighting, as well as in flexible lighting arrangements, where the compact nature of the LEDs is utilized.

One particular drawback of solid state lighting solutions is cost. For instance, because LEDs are fragile, the LEDs are usually mounted on a carrier such as a printed circuit board, which may be diced and packaged into single units. This increases the cost of the lighting arrangement, in particular if a large number of LEDs are required in the arrangement, such as for instance in a backlighting panel.

US 2009/0091932 A1 discloses a lighting arrangement according to the opening paragraph. A flexible wire grid is provided as a support for the LEDs such that large area carriers for the LEDs can be avoided, thus reducing the cost of the arrangement. The protection of the LEDs on this grid against damage however may be improved. Especially the stresses generated during the stretching step of its manufacturing process can damage the interconnects between the LEDs and the wires on which the LEDs are mounted. For this reason, the LEDs are often made more robust, for instance by placing them on a submount that protects the LEDs from these stresses, with the submount being placed on the wires. However, although this improves robustness, it also significantly increases manufacturing cost, which can be prohibitive when producing large size flexible grids (i.e. flexible grids comprising a large number of LEDs).

SUMMARY OF THE INVENTION

The present invention seeks to provide a lighting arrangement according to the opening paragraph that can be deformed without exposing the solid state lighting elements to excessive stresses that can damage the connections between the solid state lighting elements and the grid.

The present invention further seeks to provide an apparatus for deforming such a lighting arrangement.

The present invention yet further seeks to provide a method of deforming such a lighting arrangement.

According to an aspect, there is provided a lighting arrangement comprising a plurality of solid state lighting elements mounted on a grid of conductive wires, said grid comprising a plurality of grid segments, each grid segment being defined by respective portions of adjacent conductive wires, wherein each grid segment comprises a pair of reinforcement members affixed to said portions and delimiting the grid segment; and wherein for at least some of the grid segments a solid state lighting element is mounted on said portions in between the reinforcement members on at least two adjacent conductive wires, the pair of reinforcement members surrounding the solid state lighting element.

By providing reinforcement members at the edges of the grid segments, the solid state lighting elements in between the reinforcement members are protected from exposure to mechanical stresses such as stretching and/or bending forces when deforming the lighting arrangement. This facilitates the direct mounting of the solid state lighting elements on the respective portions of the adjacent conductive wires (or the mounting of the solid state lighting elements on the respective portions of the adjacent conductive wires using minimal submounts) without the need for substantial expensive submounts to protect the solid state lighting elements from damage during the deformation process, thereby providing lighting arrangement that is robust and yet can be produced in a cost-effective manner.

Each grid segment preferably comprises a plurality of solid state lighting elements in between the reinforcement members. In this manner, a lighting arrangement can be provided in which deformation in the length direction of the lighting arrangements can be reduced, as relatively long grid segments are being prevented from being bent by their reinforcement members.

In an embodiment, the conductive wires are flexible wires. This facilitates easy deformation, e.g. manual deformation without the requirement of levers. However, in an alternative embodiment the conductive wires may be relatively rigid such a deformation must be achieved using such levers. The latter embodiment may for instance be useful in application domains where the lighting arrangement is required to have a certain amount of structural rigidity, e.g. must retain its shape after deformation.

In an embodiment, the grid segments include a first group of grid segments and a further group of grid segments, wherein each grid segment of the further group includes a further portion of a first conductive wire, said first conductive wire further comprising a portion belonging to a first grid segment of the first group; and a further portion of a second conductive wire, said second conductive wire further comprising a further portion belonging to a second grid segment of the first group. In this embodiment, the grid segments are staggered relative to each other, which provides a high density of grid segments in the lighting arrangement.

At least some of the reinforcement members may be electrically insulating reinforcement members such as ceramic reinforcement members.

Alternatively, at least some of the reinforcement members may provide an electrical coupling between the respective portions.

For instance, at least some of the reinforcement members comprise a submount carrying an electrical component. In some embodiments, the electrical component is a further solid state lighting element or a resistor. In case of the electrical component being a further solid state lighting element, a high density of such solid state lighting elements is achieved, thereby increasing the luminous output of the lighting arrangement. In case of the electrical component being a resistor, the electrical properties of the lighting arrangement may be controlled without the need for (many) additional components on the conductive wires of the grid.

The lighting arrangement may further comprise at least one shunt affixed to adjacent conductive wires. Such a shunt may for instance be used to tune the electrical properties of the lighting arrangement, e.g. by comprising a further electrical component for controlling the voltage characteristics of the lighting arrangement and/or act as electrical connectors for the lighting arrangement.

In an embodiment, at least some of said shunts are reinforcement members. In an embodiment, at least some of said shunts are located adjacent to a reinforcement member, for instance on an edge of the lighting arrangement.

At least some shunts may comprise a hinging mechanism for bending the adjacent conductive wires. This facilitates a lever for deforming the lighting arrangement.

According to another aspect, there is provided an apparatus for bending the lighting arrangement according to any of the aforementioned embodiments, the apparatus comprising a pair of first wire receiving members mounted on a first support member, said first wire receiving members being spaced apart for engaging with respective points of a further portion of a first conductive wire separating neighbouring grid segments; and a pair of second wire receiving members mounted on a second support member, said second wire receiving members being spaced apart for engaging with respective points of a further portion of a second conductive wire separating said neighbouring grid segments;

wherein at least one of the first support member and the second support member is movable relative to the other of the first support member and second support member in a direction perpendicular to the direction of the first and second conductive wires when engaging with the first and second wire receiving members respectively. Such an apparatus facilitates a straightforward and simple way of deforming such a lighting arrangement, which can achieve large stretch factors without exposing the solid state lighting elements to excessive stresses during the deformation process.

According to yet another aspect, there is provided a method of bending the lighting arrangement according to any of the aforementioned embodiments, the method comprising engaging a pair of first wire receiving members with respective points of a further portion of a first conductive wire separating neighbouring grid segments; engaging a pair of second wire receiving members with respective points of a further portion of a second conductive wire separating said neighbouring grid segments; and displacing the pair of second wire receiving members relative to the pair of first wire receiving members in a direction perpendicular to the direction of the conductive wires.

Such a method facilitates a straightforward and simple way of deforming such a lighting arrangement, which can achieve large stretch factors without exposing the solid state lighting elements to excessive stresses during the deformation process.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
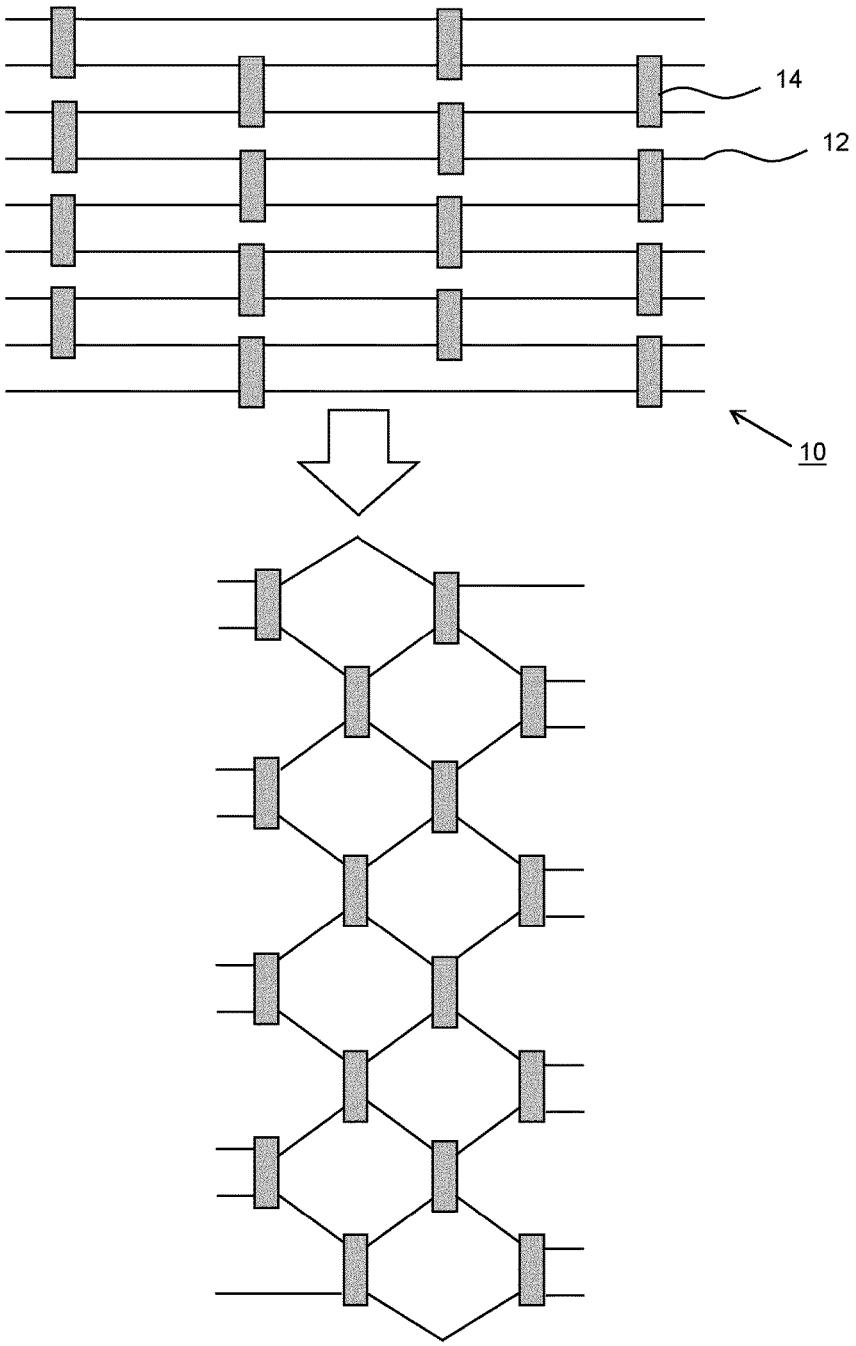
Figure 1 (prior art)
FIG. 1 schematically depicts a prior art lighting arrangement.

It should be understood that the Figures are merely schematic and are not drawn to scale. It should also be understood that the same reference numerals are used throughout the Figures to indicate the same or similar parts.

FIG. 1 schematically depicts a prior art flexible lighting arrangement 10. The flexible lighting arrangement 10 typically comprises a plurality of electrically conductive wires 12, e.g. metal wires such as copper, metal alloy wires such as steel wires, and so on. During manufacturing, the conductive wires 12 are typically arranged parallel to each other in a grid or array. A plurality of solid state lighting (SSL) elements 14, e.g. organic or inorganic light emitting diodes are mounted on the electrically conductive wires 12 such that each SSL element 14 is mounted on at least two adjacent electrically conductive wires 12. The SSL elements 14 are typically organized in columns wherein neighbouring columns are staggered relative to each other, i.e. the columns are displaced relative to each other by a single electrically conductive wire 12, as is shown in FIG. 1. Such lighting arrangements are sometimes referred to as a LED On Wire Array (LOWA).

Consequently, this staggered pattern of SSL elements 14 leads to the formation of a lighting arrangement having rhomboid cells upon deformation of the array or grid in which the SSL elements 14 define the corners of the cells. This deformation step is indicated by the block arrow in FIG. 1. It will be immediately apparent that during this deformation step, the SSL elements 14 are exposed to mechanical stress caused by the bending (and/or stretching) of the conductive wires 12 on to which the SSL elements 14 are mounted.

This effectively precludes the direct placement of the SSL elements 14 on the conductive wires 12, as such direct connections between the SSL elements 14 and the conductive wires 12 typically are unable to withstand these stresses. For this reason, the SSL elements 14 are usually mounted on a support structure or submount such as a printed circuit board, which has the benefit of increasing the robustness of the lighting arrangement 10, as bending or stretching forces applied to the flexible lighting arrangement 10 are less likely to damage the interconnections, e.g. solder points, between the SSL elements 14 and the electrically conductive wires 12. However, such submounts significantly increase the cost of the lighting arrangement 10, which can prohibit the manufacture of large lighting arrangements, e.g. lighting arrangements comprising hundreds of SSL elements 14 for cost reasons.

Another drawback of this design is that upon deformation of the lighting arrangement 10, the dimensions of the lighting arrangement 10 in the direction of the conductive wires 12 as well as perpendicular to this direction are significantly altered, i.e. the dimensions in the direction of the conductive wires are significantly reduced whereas the dimensions perpendicular to the direction are significantly increased. This for instance is not ideal if elongated lighting arrangements are required.

Figure 2:
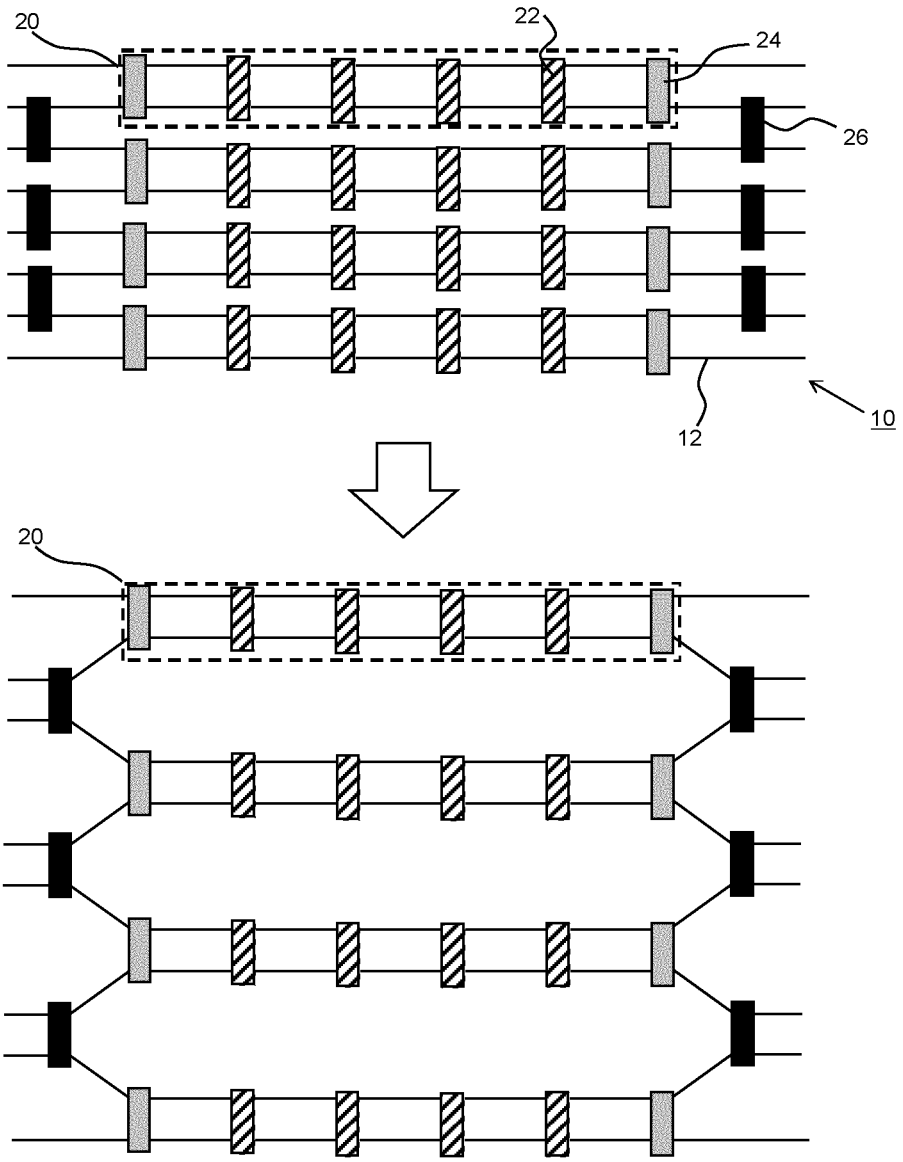
FIGS. 2 and 3 schematically depict a lighting arrangement according to an embodiment of the present invention.

FIG. 2 schematically depicts a lighting arrangement 10 according to an embodiment of the present invention. As with the prior art lighting arrangement 10, the lighting arrangement 10 according to the present invention comprises a plurality of electrically conductive wires 12 that during manufacturing are arranged in parallel. It should be understood that in the context of the present invention, an electrically conductive wire is not limited to conductive structures having a circular cross-section. Any suitably shaped elongated conductive structure, e.g. electrically conductive ribbons have square cross-sections, may be contemplated.

The lighting arrangement 10 comprises a plurality of grid segments 20, which are defined by a number of SSL elements 22, e.g. organic or inorganic light emitting diodes of any suitable colour, mounted on adjacent portions of neighbouring conductive wires 12. The grid segments 20 further comprise a pair of reinforcement members 24 that surround the SSL elements 22 and delimit the grid segment 20. In other words, the SSL elements 22 are placed in between the pair of reinforcement members 24. Consequently, several neighbouring columns of SSL elements 22 are typically placed on the same electrically conductive wires 12, which has the advantage that improved placement accuracy is achieved compared to prior art solutions in which these columns had to be placed in a staggered fashion, such as the placement scheme applied to the prior art lighting arrangement 10 shown in FIG. 1.

Each grid segment 20 may comprise any suitable number of SSL elements 22, e.g. one or more SSL elements 22. The respective grid segments 20 may comprise the same number of SSL elements 22 or may comprise different numbers of SSL elements 22 depending on the design requirements. In case of the grid segments comprising different numbers of SSL elements 22, current balancing devices such as resistors may be added to the lighting arrangement in order to homogenize the luminous output of the SSL elements 22 on different grid segments 20. Such current balancing devices may be included on the grid of electrically conductive wires 12 in any suitable manner; for instance, such current balancing devices may be integrated on the reinforcement members 24 of the applicable grid segments 20. For instance, in case the SSL elements 22 on the various grid elements 20 are to combine to form a particular image or text, different grid segments 20 will typically comprise a different number of SSL elements 22.

The reinforcement members 24 are provided to protect the SSL elements 22 from being exposed to stress during the deformation of the electrically conductive wires 12, which deformation is shown in the bottom part of FIG. 2. In other words, the reinforcement members 24 prevent the grid segment 20 from being (substantially) deformed during the deformation of the lighting arrangement 10, thereby providing a deformed lighting arrangement 10 in which sections of the lighting arrangement, i.e. the grid segments 20, substantially retain their shape and dimensions. This has a number of advantages.

Firstly, because the SSL elements 22 are protected from exposure to stresses during the deformation process of the lighting arrangement 10, the SSL elements 22 may be directly secured on the electrically conductive wires 12 using a solder. Any suitable solder composition may be used. The direct mounting of the SSL elements 120 on the various portions of the electrically conductive wires 12 has the advantage that the contacts of the SSL elements 22 can be placed into a solder paste applied on the electrically conductive wires 12, such that all SSL elements 22 can be readily soldered onto the electrically conductive wires 110. This provides a straightforward and cost-effective way of mounting the SSL elements 22 on the various portions of the electrically conductive wires 12. Alternatively, the SSL elements 22 may be secured on the various portions of adjacent electrically conductive wires 12 using a minimal submount, that is, a submount such as a PCB that provides some additional structural rigidity to the SSL element but is insufficient to protect the SSL element 22 from the stresses that are typically associated with the deformation process of the lighting arrangement 10. This therefore allows for a more cost-effective manufacture of lighting arrangements 10 comprising a large number of SSL elements 20.

Secondly, because the grid segments 20 are protected against (substantial) deformation by the reinforcement members 24, the amount of shrinkage in the length direction of the electrically conductive wires 12 is significantly reduced, thus yielding a deformed lighting arrangement 10 having hexagonally shaped cells in which a substantial reduction of the dimensions in the length direction of the lighting arrangement 10 is avoided. This is for instance useful to provide long, band-shaped lighting arrangements 10, i.e. lighting arrangements 10 that are elongated in the length direction of the electrically conductive wires 12.

Moreover, in the lighting arrangement 10 according to embodiments of the present invention the location of the SSL elements 22 on the grid of electrically conductive wires 12 is no longer related to the bending points of the grid such that the SSL elements 22 may be placed in any suitable location in between a pair of reinforcement members 24, which greatly enhances the design flexibility of the lighting arrangement 10 of the present invention compared to the prior art lighting arrangement in which the SSL elements 14 had to be placed at predetermined locations because these locations defined the bending points of the grid. This is furthermore allows for the placement of different numbers of SSL elements 22 on different grid segments 20 as previously explained.

In an embodiment, the reinforcement members 24 may be electrically insulating reinforcement members, e.g. ceramic bodies comprising a pair of slots or recesses for engaging with the respective portions of the adjacent electrically conductive wires 12 defining a grid segment 20. Alternatively, the reinforcement members 24 may comprise electrical components for regulating or tuning the electrical properties of the lighting arrangement 10. For instance, the reinforcement members 24 may comprise a submount onto which the electrical component is mounted, wherein the submount provides the structural rigidity that protects the SSL elements 22 of the grid segment 20 from stress during the deformation of the lighting arrangement 10 and wherein the submount further provides the electrical connections between the electrical component and the respective portions of the adjacent electrically conductive wires 12.

The electrical component may be any suitable component such as a resistor for controlling a voltage drop across the lighting arrangement 10, a switch such as a transistor or diode for switching the grid segment 20 on or off, a diode for suppressing voltage variations between adjacent lines or for allowing the grid segment 20 to be switched on at reverse or backwards current in order to allow strategically placed colour LEDs to provide dimmable colour functionality within one or more grid segments 20 defining a white tile within the lighting arrangement 10, an integrated circuit for providing more complex control functionality for one or more grid segments 20, and so on.

In an embodiment, the electrical component may be a further SSL element in order to provide additional luminous output for the lighting arrangement 10.

In an embodiment, the reinforcement member 24 may be a shunt providing a low-resistance bridge between adjacent electrically conductive wires 12. Such a shunt may include any suitable electrical component such as an inductor, capacitor or resistor, for instance to address the grid segment 20 using voltage amplitude or frequency modulation techniques. A resistor may also be used to control voltage drop along the grid. This is for instance beneficial in controlling bin variations between neighbouring lighting arrangements 10 in a structure comprising a plurality of such arrangements to ensure that each arrangement produces the same luminous output intensity.

Alternatively or additionally, the shunt may include a connector for providing an external contact to the lighting arrangement 10. This for instance can be beneficial in elongated lighting arrangements 10, wherein secondary connectors may be required in order to connect a driver circuit (not shown) to the lighting arrangement 10 and/or to provide additional power connections to the lighting arrangement 10 in order to prevent an excessive voltage drop over the grid.

At this point, it is noted that a pair of reinforcement members 24 may include a first reinforcement member and a second reinforcement member that is different to the first reinforcement member. For instance, the reinforcement members 24 may be submounts or shunts comprising different electrical components, or the first reinforcement member 24 may comprise a submount whereas the second reinforcement member 24 may comprise a shunt, one of the reinforcement members 24 may be an electrically insulating reinforcement member whereas the other reinforcement member 24 may comprise an electrical component, and so on.

In the embodiment shown in FIG. 2, the lighting arrangement 10 further comprises further reinforcement members 26 that for instance may be placed at the edge portions of the lighting arrangement 10 to prevent unwanted deformation of these edge portions during the stretching of the lighting arrangement 10. In an embodiment, the further reinforcement members 26 may be shunts as explained above although it is equally feasible to use a different type of further reinforcement member 26 depending on the design requirements of the lighting arrangement, e.g. an electrically insulating further reinforcement member 26 or a further reinforcement member 26 comprising a submount carrying an electrical component as explained above.

Different types of further reinforcement members 26 may be used in different locations of the lighting arrangement 10. The further reinforcement members 26 may be placed such that the further reinforcement member 26 is mounted on a first further portion of a first electrically conductive wire 12, which first further portion is adjacent to a portion of the first electrically conductive wire 12 belonging to a first grid segment 20 and on a second further portion of a second electrically conductive wire 12, which second further portion is adjacent to a portion of the second electrically conductive wire 12 belonging to a second grid segment 20. The first and second electrically conductive wires 12 typically are adjacent wires.

In an embodiment, some of the reinforcement members 24 and/or further reinforcement members 26 may comprise a fixing member for fixing the lighting arrangement 10 to an external surface such as a wall or ceiling. Such a fixing member may for instance include a hole through the (further) reinforcement member for receiving a screw, nail or the like, a hook or pad on the back of the grid node for mating with a fixing on the external surface, and so on. The fixing member may be included in a (further) reinforcement member further comprising an electrical circuit element as described above or may form part of a separate (further) reinforcement member dedicated to the fixing of the lighting arrangement 10 to the external surface.

Figure 3:
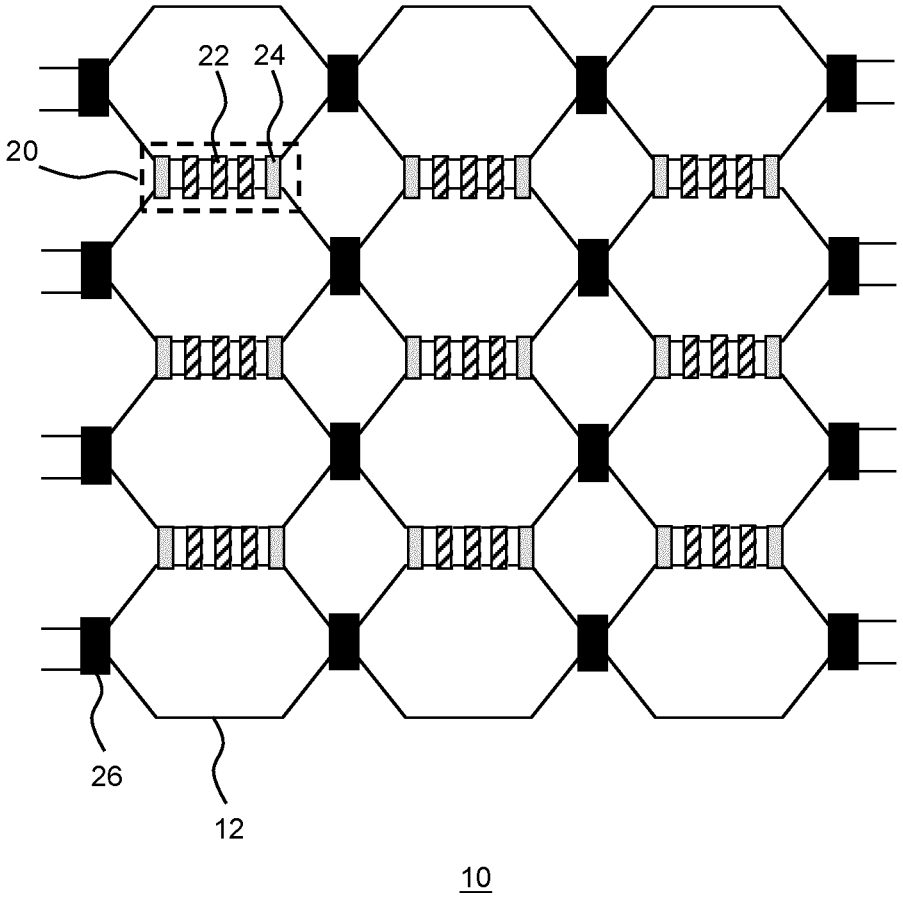

In an embodiment, further reinforcement members 26 may be placed in between reinforcement members 24 of neighbouring grid segments 20 along the length direction of the electrically conductive wires 12. This is shown in FIG. 3. This yields a lighting arrangement 10 in which hexagonal cells carrying SSL elements 22 on opposite sides are joined by rhomboid cells with a pair of reinforcement members 24 and a pair of further reinforcement members 26 on opposite edges of such a rhomboid cell. In some embodiments, the further reinforcement members 26 may comprise a hinge mechanism that when engaged deforms a portion of the lighting arrangement 10 to which the further reinforcement member 26 is attached.

Figure 4:
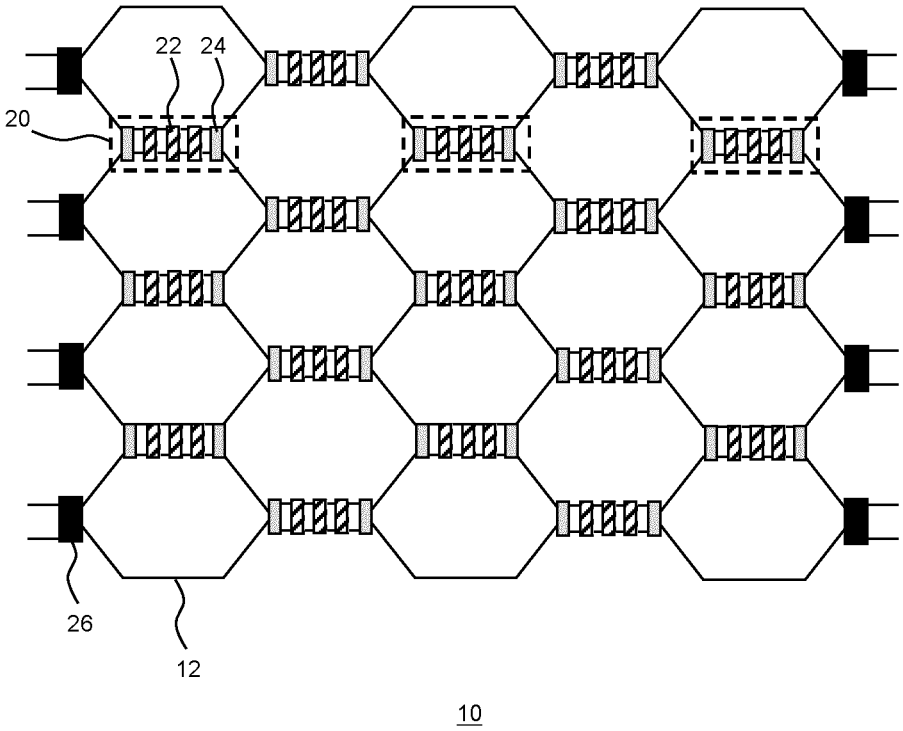
FIG. 4 schematically depicts a lighting arrangement according to another embodiment of the present invention.
Figure 5:
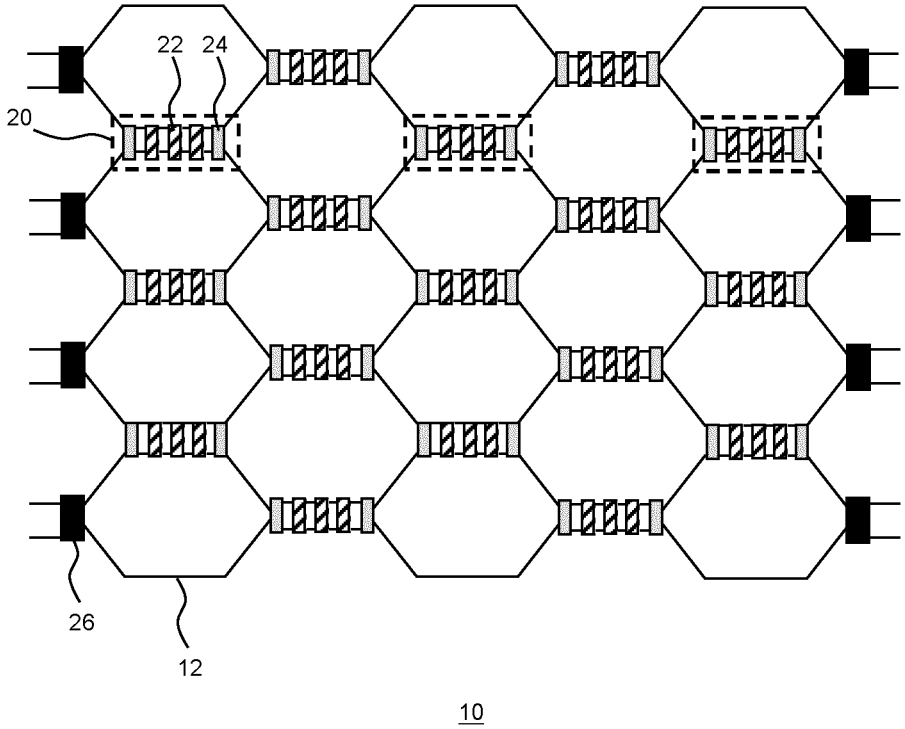
FIG. 5 schematically depicts a lighting arrangement according to yet another embodiment of the present invention.

In an alternative embodiment, further reinforcement members 26 are placed on the edges of the lighting arrangement 10 only. This is shown in FIG. 4, in which the further reinforcement members 26 are electrically insulating members. This yields a lighting arrangement 10 in which a staggered or honeycomb pattern of hexagonal cells carrying SSL elements 22 in between reinforcement members 24 is obtained. In this embodiment, groups of columns of SSL elements 22 are placed in a staggered fashion on the grid of electrically conductive wires 12. This embodiment may provide a higher density of SSL elements 22 on the grid of electrically conductive wires 12 at the expense of fewer reinforcement members in the grid, which may equate to fewer electrical components for controlling the lighting arrangement 10 in the grid. It is furthermore feasible to alter the inter-reinforcement member distance between neighbouring grid segments 20 or between a reinforcement member 24 at the edge of a grid segment and a further reinforcement member 26 in order to control the amount of stretch or separation between grid segments 20 in the direction perpendicular to the length direction of the electrically conductive wires 12. This is shown in FIG. 5. As can be seen from the central pair of grid segments 20 in the lighting arrangement 10, by reducing the distance between the respective reinforcement members 24 on the one hand and an adjacent reinforcement member (here shown as a further reinforcement member 26 by way of non-limiting example), the amount of separation or space between such adjacent grid segments 20 can be controlled.

At this point, it is noted that in the aforementioned embodiments of the lighting arrangement 10 each grid segment 20 is shown to include a pair of adjacent electrically conductive wires 12 by way of non-limiting example only. It should be understood that it is equally feasible that such grid segments 20 comprise more than two adjacent electrically conductive wires 12; for instance a third electrically conductive wire 12 may form part of the grid segment 20, which additional wire can act as a control wire for providing each of the SSL elements 22 with individual control signals. A reinforcement member 24 may for instance comprise an IC that generates such control signals and provides the signals to the respective SSL elements 22 over this third electrically conductive wire 12. Other embodiments in which additional wires are included in the grid segments 20 to provide additional functionality to these grid segments will be apparent to the skilled person.

Figure 6:
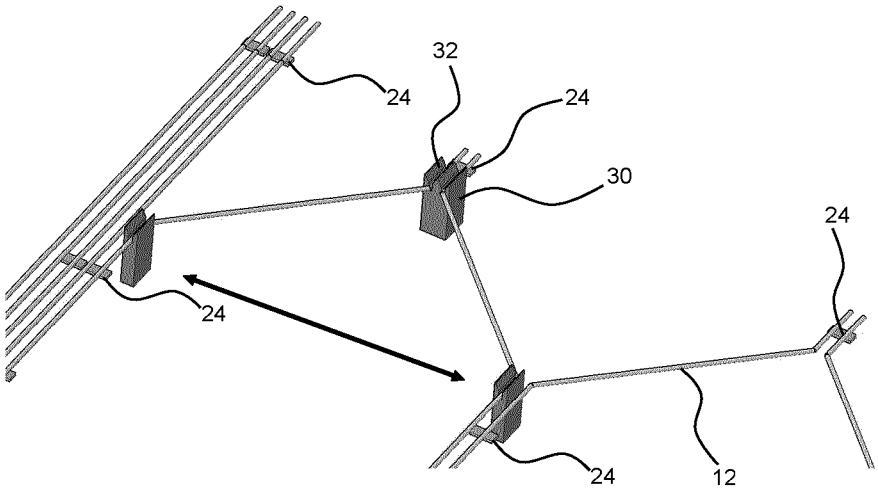
FIG. 6 schematically depicts a method of deforming a lighting arrangement according to an embodiment of the present invention.

Embodiments of the lighting arrangement 10 of the present invention further allow for the stretching of individual (hexagonal) cells using straightforward and affordable stretching methods. The first embodiment of such a stretching or deformation method is shown in FIG. 6, wherein this method is applied to the lighting arrangement 10 as shown in FIG. 4. In this embodiment, three bending members 30 including grooves 32 for receiving individual electrically conductive wires 12 of the lighting arrangement 10 are placed such that a first and second bending member are placed outside adjacent grid segments 20 and a third bending member 30 is placed outside the neighbouring grid segment 20 that includes a further portion of one of the conductive wires 12 from each of the adjacent grid segments as explained in more detail with the aid of FIG. 4. It can be seen that the bending members 30 are placed such that the reinforcement members 24 of the respective grid segments 20 are placed in between the bending members 30 and the SSL elements of these grid segments 20, thereby protecting the SSL elements from mechanical stresses, e.g. bending forces. In order to bend or deform the lighting arrangement 10, the first and second bending members 30 may be pushed apart in a direction perpendicular to the electrically conductive wires 12, as shown by the double arrow in FIG. 6, thereby forming the aforementioned hexagonal cells.

Figure 7:
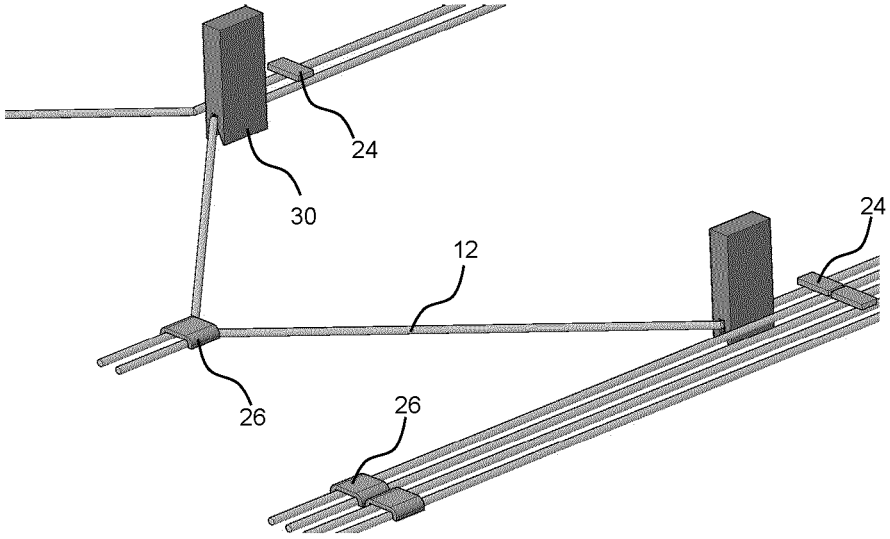
FIG. 7 schematically depicts a method of deforming another lighting arrangement according to an embodiment of the present invention.

The same principle may also be applied to the lighting arrangement 10 as shown in FIG. 3. This is shown in FIG. 7. In this embodiment, a pair of bending members 30 are placed outside adjacent grid segments 20 and facing a further reinforcement member 26 such as a shunt. As before, the first and second bending members 30 may be pushed apart in a direction perpendicular to the electrically conductive wires 12 in order to obtain the desired deformation of the lighting arrangement 10. In an embodiment, the further reinforcement member 26 may be temporarily mounted on the wire grid to assist in the bending process, and may be removed upon completion of this process. In an alternative embodiment, the further reinforcement members 26 may be permanently mounted on the wire grid as previously explained.

Figure 8:
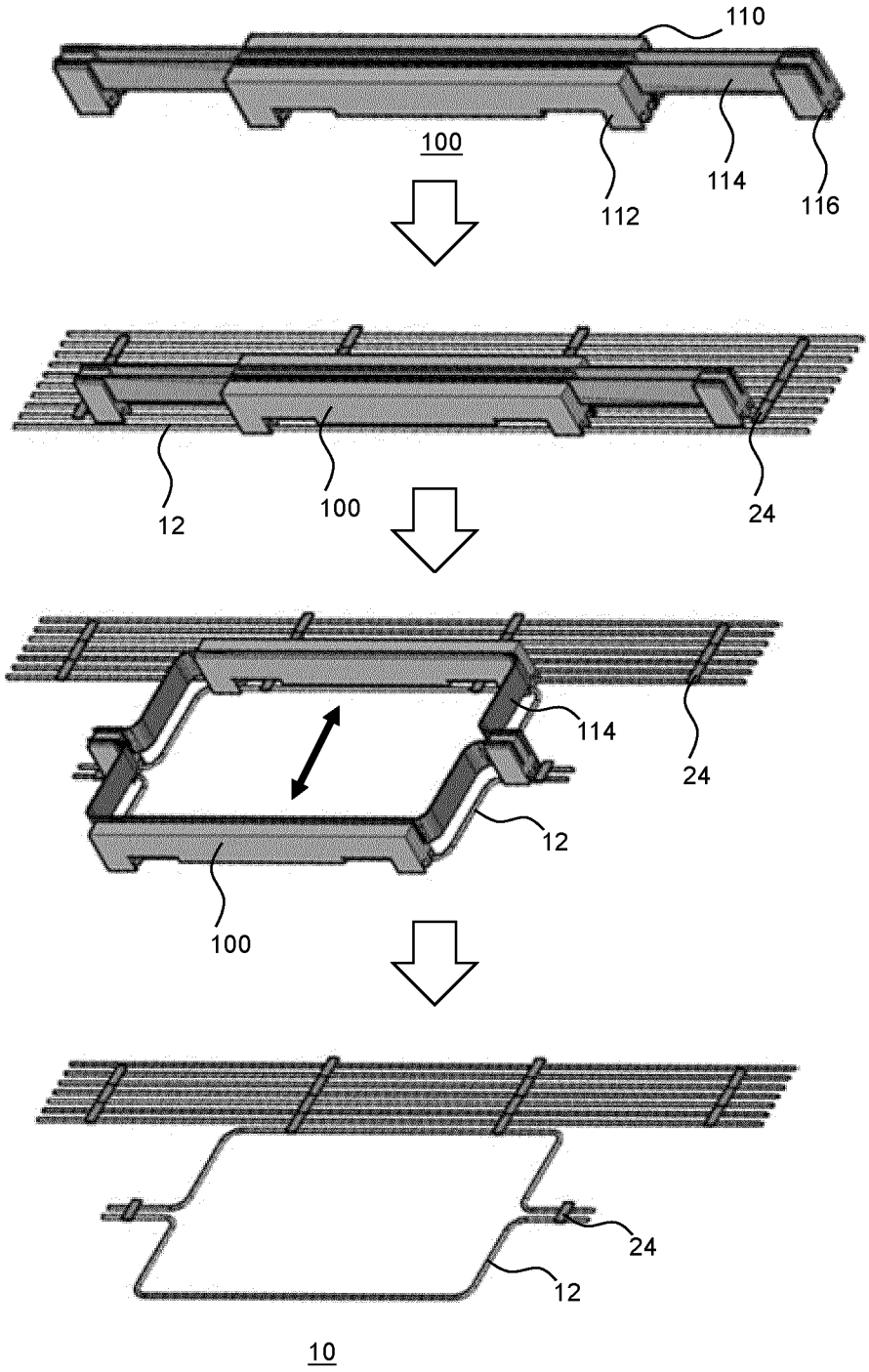
FIG. 8 schematically depicts a method of deforming a lighting arrangement according to another embodiment of the present invention.

FIG. 8 schematically depicts a method of deforming a lighting arrangement 10 according to an embodiment of the present invention using a deforming apparatus 100. The apparatus 100 comprises a first arm 110 and a second arm 112 each attached to a flexible portion 114. Each arm comprises a groove 116 for engaging with a wire portion of electrically conductive wire 12 of the lighting arrangement 10. In the top pane of FIG. 8, the apparatus 100 is shown in its closed configuration, in which the respective grooves 116 of the first arm 110 and the second arm 112 are spaced apart such that these grooves can receive adjacent wire portions.

In order to bend part of the lighting arrangement 10, the apparatus 100 may be placed in its closed configuration on the desired portions of adjacent electrically conductive wires 12 as shown in the second pane of FIG. 8. It is noted that the central arm portions typically straddle at least one grid segment 20 such that sections of the grid on opposite ends of the at least one grid segment 20 can be simultaneously deformed. This is shown in the third pane of FIG. 8, in which the apparatus 100 is pushed open such that the flexible portions 114 are forced to extend substantially perpendicularly from the first arm 110 to the second arm 112 of the apparatus 100. The apparatus 100 may be subsequently removed to leave a deformed section of the lighting arrangement 10 as shown in the bottom pane of FIG. 8.

Figure 9:
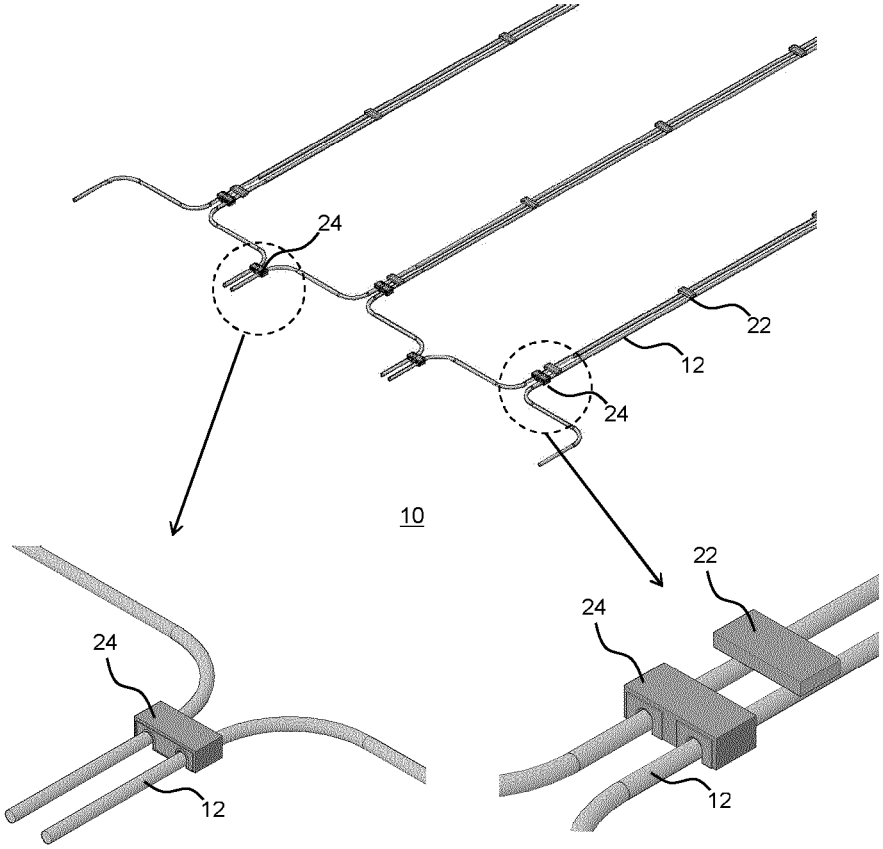
FIG. 9 schematically depicts a detail of a lighting arrangement according to an embodiment of the present invention after deformation in accordance with the method of FIG. 8.

FIG. 9 schematically depicts an example embodiment of a lighting arrangement 10 that has been deformed in this manner. As can be seen, a large separation of adjacent grid segments 20 can be achieved in this manner, with the grid segments 20 adopting a substantially rectangular shape in which multiple SSL elements 22 may be placed on the straight runs, i.e. the straight grid segments 20, which are being kept straight by the provision of the reinforcement members 24 that prevent adjacent wire portions of the grid segments 20 from bending as previously explained. The further portions of an electrically conductive wire 12 in between neighbouring grid segments 20 are bent into an S-shape (or inverted S-shape) using the apparatus 100 to achieve maximum separation between adjacent grid segments 20.

In the magnified portions of FIG. 9, the reinforcement members 24 can be recognised as shunts. It is emphasised that the reinforcement members 24 are shown as shunts by way of non-limiting example only; any suitable type of reinforcement member 24 may be used. The shunts may take any suitable form, e.g. shunts based on printed circuit board technology as shown in FIG. 9.

At this point, it is noted that in some embodiments of the present invention the electrically conductive wires 12 of the lighting arrangement 10 are flexible wires, i.e. wires that can be easily deformed without requiring levers such as the bending members 30 or the apparatus 100. However, this is not strictly necessary. Because the reinforcement members 24 protect the SSL elements 22 from exposure to stresses during the bending or deformation of the grid of wires 12, relatively large mechanical stresses, e.g. bending forces can be applied to these grid, such as the large bending achieved by the apparatus 100. Consequently, in at least some embodiments of the present invention electrically conductive wires 12 may be used that are relatively rigid, e.g. rigid to an extent that these wires retain their shape in the absence of such relatively large bending forces. This for instance may be achieved by increasing the diameter or the size of the cross-section of the electrically conductive wires 12. This has the advantage that wire sagging can be avoided, which facilitates the manufacture of large-size lighting arrangements 10 capable of excellent shape retention.

Figure 10:
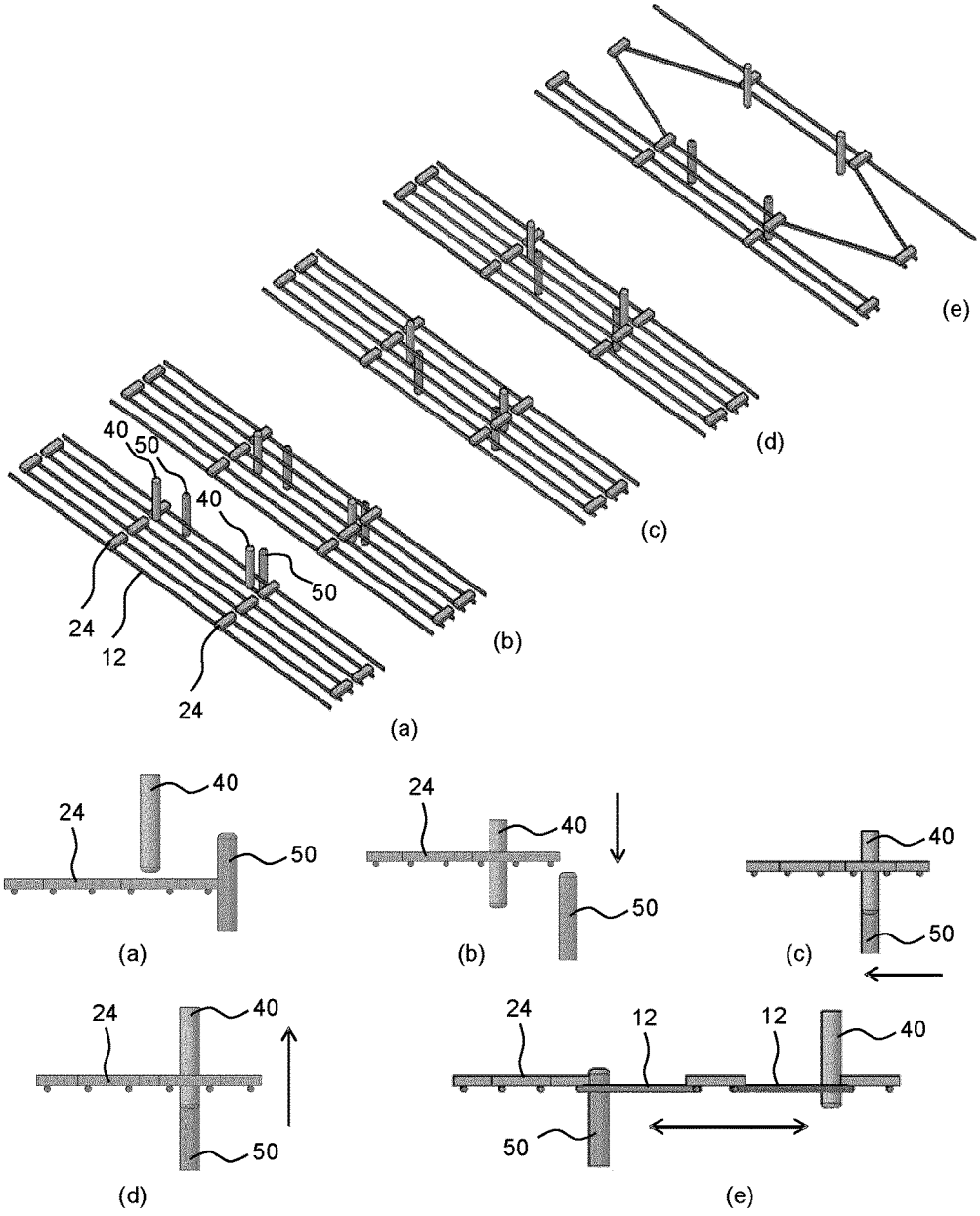
FIG. 10 schematically depicts a method of deforming a lighting arrangement according to yet another embodiment of the present invention.
Figure 11:
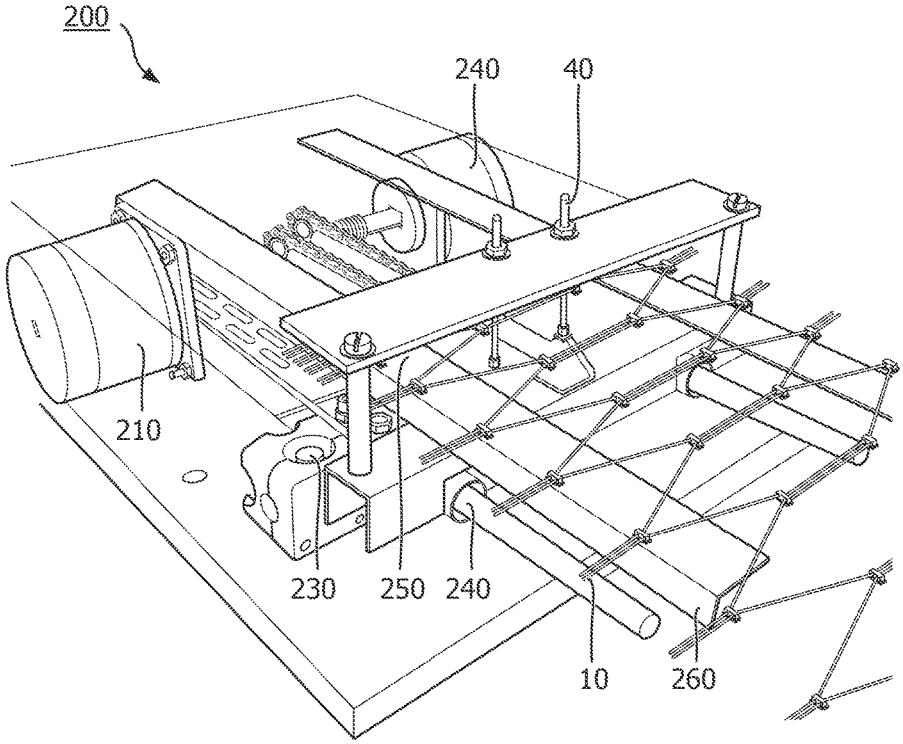
FIG. 11 shows an image of an example embodiment of an apparatus for deforming a lighting arrangement according to an embodiment of the present invention.

The deformation process of the lighting arrangement 10 may be fully automated. FIG. 10 schematically depicts such an automated deformation method and FIG. 11 shows an image of an apparatus 200 for implementing this method.

The apparatus 200 comprises a pair of first wire receiving members mounted 40 on a first support member 250 and a pair of second wire receiving members 50 mounted on a second support member (not shown). The first wire receiving members 40 and the second wire receiving members 50 are typically spaced apart such that they can fit in between neighbouring grid segments 20.

The apparatus 200 further comprises a first motor 210 for displacing the first support member 250 and the second support member in a simultaneous fashion by driving a shaft in a first bearing 230 and a second motor 220 for horizontally displacing the second support member relative to the first support member 250 by driving a shaft in a second bearing 240. Alternatively, the first support member 250 as the second support member may be individually displaced in the vertical direction. This may for instance be achieved by the provision of additional motor or by providing a transfer mechanism that can switch the first motor 210 from a first configuration in which the first motor 210 engages with the first support member 250 to a second configuration in which the first motor 210 engages with the second support member.

In an embodiment, the first wire receiving members 40 and the second wire receiving members 50 may be vertically displaced relative to each other as can be seen in FIG. 10. The apparatus 200 may further comprise a carrier 260 arranged to carry the lighting arrangement 10 during the deformation or stretching process.

The operation of the apparatus 200 will be explained with the aid of FIG. 10. In step (a), the first wire receiving members 40 are positioned over a section of the grid to be deformed such that the first wire receiving members 40 each are positioned over a location adjacent to a reinforcement member 24 of a grid segment 20 adjacent to the section to be deformed. This is achieved by appropriate control of the first motor 210 and/or the second motor 220.

Next, the first wire receiving members 40 are lowered into the grid by controlling the first motor 210 as shown in step (b). This leads to an arrangement in which the first wire receiving members 40 are flanked by respective reinforcement members 24 of neighbouring grid segments 20 in the length direction of the electrically conductive wires 12, and in which the first wire receiving members 40 engage with a further portion of a first electrically conductive wire 12 of the section to be deformed.

In step (c), the second wire receiving members 50 are being positioned over the section of the grid to be deformed by means of the second motor 220 such that the second wire receiving members 50 each are also positioned over the section to be deformed. In step (d), the second wire receiving members 50 are raised into this section by controlling the first motor 210 such that both the first wire receiving members 40 and the second wire receiving members 50 now engage with respective portions of the opposite electrically conductive wires 12 of this section.

Now, the first wire receiving members 40 and the second wire receiving members 50 may be horizontally separated from each other in a direction perpendicular to the electrically conductive wires 12 by the second motor 220 as shown in step (e). Because the wire receiving members 40 and 50 engage with the aforementioned further portions of the opposite electrically conductive wires 12, these further portions are also horizontally separated from each other, thus causing the deformation of the associated section of the grid. Steps (a) to (e) may be repeated until all grid sections have been deformed in this matter, thus leading to a highly reproducible bending of the various portions of the electrically conductive wires 12 of the grid. Consequently, a deformed lighting arrangement 10 can be obtained having highly uniform deformations.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting arrangement comprising:

a plurality of solid state lighting elements; and a grid of conductive wires with the plurality of solid state lighting elements mounted thereon, the grid comprising a plurality of grid segments, each grid segment being defined by respective portions of adjacent conductive wires, wherein each grid segment comprises a pair of reinforcement members affixed to said portions of adjacent conductive wires and delimiting the grid segment, wherein the reinforcement members are electrically insulating, and wherein for at least some of the grid segments at least one solid state lighting element is mounted on said portions of at least two adjacent conductive wires in between and electrically separate from the reinforcement members, the pair of reinforcement members surrounding the at least one solid state lighting element.

2. The lighting arrangement of claim 1, wherein each grid segment comprises two or more solid state lighting elements in between the reinforcement members, and wherein at least some of the solid state lighting elements are directly mounted on said portions.

3. The lighting arrangement of claim 1, wherein the conductive wires are flexible wires.

4. The lighting arrangement of claim 1, wherein the grid segments include a first group of grid segments and a further group of grid segments, wherein each grid segment of the further group includes:

a further portion of a first conductive wire, said first conductive wire further comprising a portion belonging to a first grid segment of the first group; and a further portion of a second conductive wire, said second conductive wire further comprising a further portion belonging to a second grid segment of the first group.

5. The lighting arrangement of claim 1, wherein at least some of the reinforcement members provide an electrical coupling between the respective portions.

6. The lighting arrangement of claim 5, wherein at least some of the reinforcement members comprise a submount carrying an electrical component.

7. The lighting arrangement of claim 6, wherein the electrical component is a further solid state lighting element or resistor.

8. The lighting arrangement of claim 1, further comprising at least one shunt affixed to adjacent conductive wires.

9. The lighting arrangement of claim 8, wherein at least some of said shunts are reinforcement members.

10. The lighting arrangement of claim 8, wherein at least some of said shunts are located in between reinforcement members of neighboring grid segments.

11. The lighting arrangement of claim 9, wherein the at least some shunts comprise a hinging mechanism for bending the adjacent conductive wires.

12. The lighting arrangement of claim 8, wherein the shunt comprises a further electrical component for controlling the voltage characteristics of the lighting arrangement.

13. An apparatus for bending the lighting arrangement of claim 1, the apparatus comprising:

a pair of first wire receiving members mounted on a first support member, said first wire receiving members being spaced apart for engaging with respective points of a further portion of a first conductive wire separating neighboring grid segments; and a pair of second wire receiving members mounted on a second support member, said second wire receiving members being spaced apart for engaging with respective points of a further portion of a second conductive wire separating said neighboring grid segments;

wherein at least one of the first support member and the second support member is movable relative to the other of the first support member and second support member in a direction perpendicular to the direction of the first and second conductive wires when engaging with the first and second wire receiving members respectively.

14. A method of bending the lighting arrangement of claim 1, the method comprising the steps of:

engaging a pair of first wire receiving members with respective points of a further portion of a first conductive wire separating neighboring grid segments;

engaging a pair of second wire receiving members with respective points of a further portion of a second conductive wire separating said neighboring grid segments; and displacing the pair of second wire receiving members relative to the pair of first wire receiving members in a direction perpendicular to the direction of the conductive wires.

* * * * *